US010907394B2

(12) United States Patent
Thevenet et al.

(10) Patent No.: US 10,907,394 B2
(45) Date of Patent: Feb. 2, 2021

(54) DIAGNOSTIC OPERATION METHOD AND SYSTEM FOR A TRANSPORT VEHICLE AUTOMATIC OR SEMI-AUTOMATIC ACCESS DEVICE

(71) Applicant: Alstom Transport Technologies, Saint-Ouen (FR)

(72) Inventors: Quentin Thevenet, Paris (FR); Benjamin Lamoureux, Paris (FR); Frédéric Setan, Sepmeries (FR); Laurent Vagner, Courbevoie (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 189 days.

(21) Appl. No.: 16/162,624

(22) Filed: Oct. 17, 2018

(65) Prior Publication Data

US 2019/0112857 A1 Apr. 18, 2019

(30) Foreign Application Priority Data

Oct. 18, 2017 (FR) ..... 17 59767

(51) Int. Cl.

| | |
|---|---|
| ***E05F 15/00*** | (2015.01) |
| ***E05F 15/41*** | (2015.01) |
| ***E01B 15/00*** | (2006.01) |
| ***B61D 19/00*** | (2006.01) |

(Continued)

(52) U.S. Cl.

CPC ..... *E05F 15/41* (2015.01); *B61D 19/00* (2013.01); *E01B 15/00* (2013.01); *E05F 15/70* (2015.01);

(Continued)

(58) Field of Classification Search

CPC . E05F 15/00; E05F 15/40; E05F 15/70; E05F 15/41; E05F 15/60; G06F 11/2263;

(Continued)

(56) References Cited

U.S. PATENT DOCUMENTS 5,069,000 A * 12/1991 Zuckerman ..... B60J 5/06 49/214
6,636,814 B1 * 10/2003 McCullers ..... B61D 19/02 702/34

(Continued)

FOREIGN PATENT DOCUMENTS

| | | |
|---|---|---|
| DE | 20015495 U1 | 2/2002 |
| EP | 3038048 A1 | 6/2016 |
| WO | 01/34446 A1 | 5/2001 |

OTHER PUBLICATIONS

Search Report for FR Application 1759767 dated Jul. 12, 2018.

*Primary Examiner* — Chi Q Nguyen

(74) *Attorney, Agent, or Firm* — Thompson Coburn LLP; Thaddeus J. Blenke

(57) ABSTRACT

A health status assessment method and system for a transport vehicle automatic or semi-automatic access device is disclosed. The health status assessment system has at least one leaf actuated by a kinematic chain including at least one motor having an associated angular position or rotation speed encoder and at least one switch. The health status assessment method includes steps for analyzing at least one actuating cycle of the kinematic chain between a first and a second position wherein, during one said cycle, information is acquired representative of the electrical energy consumed by the motor, or position or speed information provided by said encoder or binary information indicating positions of switches. The method further includes dividing said cycle into a plurality of functional segments based on said acquired information, calculating at least one descriptor value, and then establishing a health status diagnosis of the health status assessment system.

13 Claims, 2 Drawing Sheets

(51) Int. Cl.
*E05F 15/70* (2015.01)
*E05F 15/60* (2015.01)

(52) U.S. Cl.
CPC ..... *E05F 15/60* (2015.01); *E05Y 2400/315* (2013.01); *E05Y 2400/32* (2013.01); *E05Y 2400/36* (2013.01); *E05Y 2400/50* (2013.01); *E05Y 2900/506* (2013.01); *E05Y 2900/51* (2013.01)

(58) Field of Classification Search
CPC ..... G05B 23/0283; E01B 15/00; B61D 19/00; B61D 19/02; B61D 19/005; B61D 19/008; E05Y 2900/51; E05Y 2400/36; E05Y 2400/50; E05Y 2400/315; E05Y 2400/32; E05Y 2900/32; E05Y 2900/531
USPC ..... 49/28, 349, 26, 39; 701/31.9, 34.4, 19; 700/83
See application file for complete search history.

(56) References Cited

U.S. PATENT DOCUMENTS

| | | | | |
|---|---|---|---|---|
| 7,810,282 | B2 * | 10/2010 | Oxley | E05F 15/638 49/358 |
| 8,278,862 | B2 * | 10/2012 | Coleman | H02H 7/0851 318/432 |
| 10,199,981 | B2 * | 2/2019 | Hall | H02P 29/40 |
| 10,655,377 | B2 * | 5/2020 | Goetzelmann | E05F 15/41 |
| 2005/0151495 | A1 * | 7/2005 | Miyauchi | E05F 15/41 318/469 |
| 2010/0242368 | A1 * | 9/2010 | Yulkowski | E05F 15/40 49/349 |
| 2014/0020299 | A1 * | 1/2014 | Takahashi | E05B 83/363 49/173 |
| 2016/0180610 | A1 * | 6/2016 | Ganguli | G06Q 30/018 701/31.9 |

* cited by examiner

DIAGNOSTIC OPERATION METHOD AND SYSTEM FOR A TRANSPORT VEHICLE AUTOMATIC OR SEMI-AUTOMATIC ACCESS DEVICE

CROSS-REFERENCE AND PRIORITY CLAIM TO RELATED APPLICATIONS

This patent application claims priority to French patent application FR 17 59767, filed Oct. 18, 2017, the entire disclosure of which is incorporated herein by reference.

INTRODUCTION

The present invention relates to a health status assessment method for a transport vehicle automatic or semi-automatic access device, a health status assessment system of such an automatic or semi-automatic device and a transport vehicle equipped with such a system.

The invention belongs to the field of the maintenance of transport vehicles, in particular railway vehicles.

The health status assessment of a system comprises detecting degradations that may cause failures and characterizing each degradation: identifying the component(s) at the source of the observed degradation, identifying the type of degradation and estimating the severity of the degradation.

The vehicle automatic or semi-automatic access devices in question in particular comprise doors or bridging plates, also known as fall arrestors, of the type comprising at least one leaf suitable for being actuated by a kinematic chain including at least one motor supplied with electricity and possibly having an associated angular position and/or rotation speed encoder.

Reducing the costs of maintenance operations, failures during use and downtime are three major areas for improvement in the railway industry. Automatic or semi-automatic access devices, for example passenger access doors, make up a significant portion of the potential areas for improvement because there are many of them on a vehicle like a train, the maintenance costs, vehicle availability and reliability then being even more affected. This is why it is crucial to ensure that they work properly by monitoring the evolution of their health over time. In particular, there is a dual objective: to detect degradations that may cause failures and to diagnose (locate, identify and estimate the severity of) said degradations, far enough upstream from the occurrence of a failure and without major alteration of the existing products. For example, the number of sensors or additional acquisition cards must be limited.

Furthermore, it is important to see to the proper operation within preestablished safety margins, i.e., the diagnostic system must not affect the security of the access devices.

Lastly, in case of anticipated failure, it is useful to identify the components, parts of the kinematic chain having a downgraded behavior, mechanical issues, as well as consumable shortages, for example grease.

The invention aims to provide a detection of degradations and a health status assessment for a transport vehicle automatic or semi-automatic access device in said context.

To that end, the invention relates to a health status assessment method for a transport vehicle automatic or semi-automatic access device comprising at least one leaf suitable for being actuated by a kinematic chain including at least one motor supplied with electricity and having an associated angular position and/or rotation speed encoder and preferably at least one switch, the access device being movable between an open position and a closed position.

This method is characterized by steps, carried out by a processor, for at least one actuating cycle of the kinematic chain between a first position among the open and closed positions and a second position, different from the first position, from among the closed and open positions of the access device, consisting of:

- during one said cycle, acquiring information relative to the kinematic chain comprising at least one piece of information representative of the electrical energy consumed by the motor, and/or position and/or speed information provided by said encoder and/or binary information indicating positions of switches of the actuating kinematic chain,
- dividing said cycle into a plurality of functional segments based on said acquired information,
- calculating at least one descriptor value per functional segment,
- establishing a health status diagnosis comprising a degradation detection as a function of at least part of said calculated descriptor values, and, if a degradation is detected, the method further includes:
- calculating one or several individual health indicators per functional segment,
- calculating at least one signature vector including at least some of the individual health indicators,
- estimating a similarity measurement between said signature vector and at least one reference signature vector representative of a degradation type, and
- identifying a type of degradation based on the estimate of a similarity measurement.

Advantageously, the method according to the invention makes it possible to characterize each actuation cycle of the kinematic chain in several functional segments, and therefore to characterize its operation finely.

The method according to the invention may have one or more of the features below, considered independently or in all technically acceptable combinations.

The division into functional segments further uses acceleration/deceleration information of the motor used from information provided by said encoder.

Each functional segment has an associated time interval, and the descriptors are representative of the electrical energy consumed during said time interval and/or a duration of the functional segment.

The method comprises determining acceleration/deceleration information of the motor from position and/or speed information provided by said encoder, and said descriptor values comprise values representative of the speed or the average acceleration/deceleration of the motor during the time interval associated with each segment.

The method comprises, before establishing a diagnosis, calculating an overall health indicator based on a distance between a vector comprising all of the calculated descriptor values and a vector of reference values of corresponding descriptors previously stored.

According to one feature, said distance is a statistical distance or a Euclidean distance.

Establishing a health status assessment comprises comparing the calculated distance to a predetermined health the operating threshold.

According to one particular feature, the similarity measurement is a cosine similarity measurement.

The method further comprises estimating a detected degradation severity value, based on the signature vector and the reference signature vector associated with the identified degradation type.

An alarm is raised if a detected degradation severity value exceeds a predetermined severity threshold.

The method comprises acquiring context information before the division into functional segments, and the calculation of at least one descriptor value per functional segment is done based on at least one piece of context information.

According to another aspect, the invention relates to a health status assessment system for a transport vehicle automatic or semi-automatic access device comprising at least one leaf suitable for being actuated by a kinematic chain comprises at least one motor supplied with electricity and having an associated angular position and/or rotation speed encoder and preferably at least one switch, the access device being movable between an open position and a closed position. Said system is characterized in that it comprises a computing unit including at least one processor, suitable for carrying out, for at least one actuating cycle of the kinematic chain between a first position among the open and closed positions and a second position, different from the first position, from among the closed and open positions of the access device, modules suitable for:

- during one said cycle, acquiring information relative to the kinematic chain comprising at least one piece of information representative of the electrical energy consumed by the motor, and/or position and/or speed information provided by said encoder and/or binary information indicating positions of switches of the actuating kinematic chain,
- dividing said cycle into a plurality of functional segments based on said acquired information,
- calculating at least one descriptor value per functional segment,
- establishing a health status diagnosis comprising a degradation detection as a function of at least part of said calculated descriptor values, the computing unit being suitable, if a degradation is detected, for:
- calculating one or several individual health indicators per functional segment,
- calculating at least one signature vector including at least some of the individual health indicators,
- estimating a similarity measurement between said signature vector and at least one reference signature vector representative of a degradation type, and
- identifying a type of degradation based on the estimate of a similarity measurement.

The invention also relates to a transport vehicle including a plurality of automatic or semi-automatic access devices, each automatic or semi-automatic access device comprising at least one leaf able to be actuated by a kinematic chain including at least one motor supplied with electricity and having an associated angular position and/or rotation speed encoder, and being equipped with a health status assessment system for the automatic or semi-automatic access device as briefly described above.

BRIEF DESCRIPTION OF THE DRAWINGS

Other features and advantages of the invention will emerge from the description thereof provided below, for information and non-limitingly, in reference to the appended figures, in which.

DETAILED DESCRIPTION OF EXAMPLE EMBODIMENTS

The invention will be described below as it applies to the health status assessment of automatic or semi-automatic doors of a railway transport vehicle.

It is understood that the invention is not limited to this application, and applies similarly to the health status assessment of another transport vehicle automatic or semi-automatic access device, for example a bridging plate, which serves to bridge a horizontal gap between the vehicle and the loading/unloading platform (for example a train or subway platform).

Figure 1:
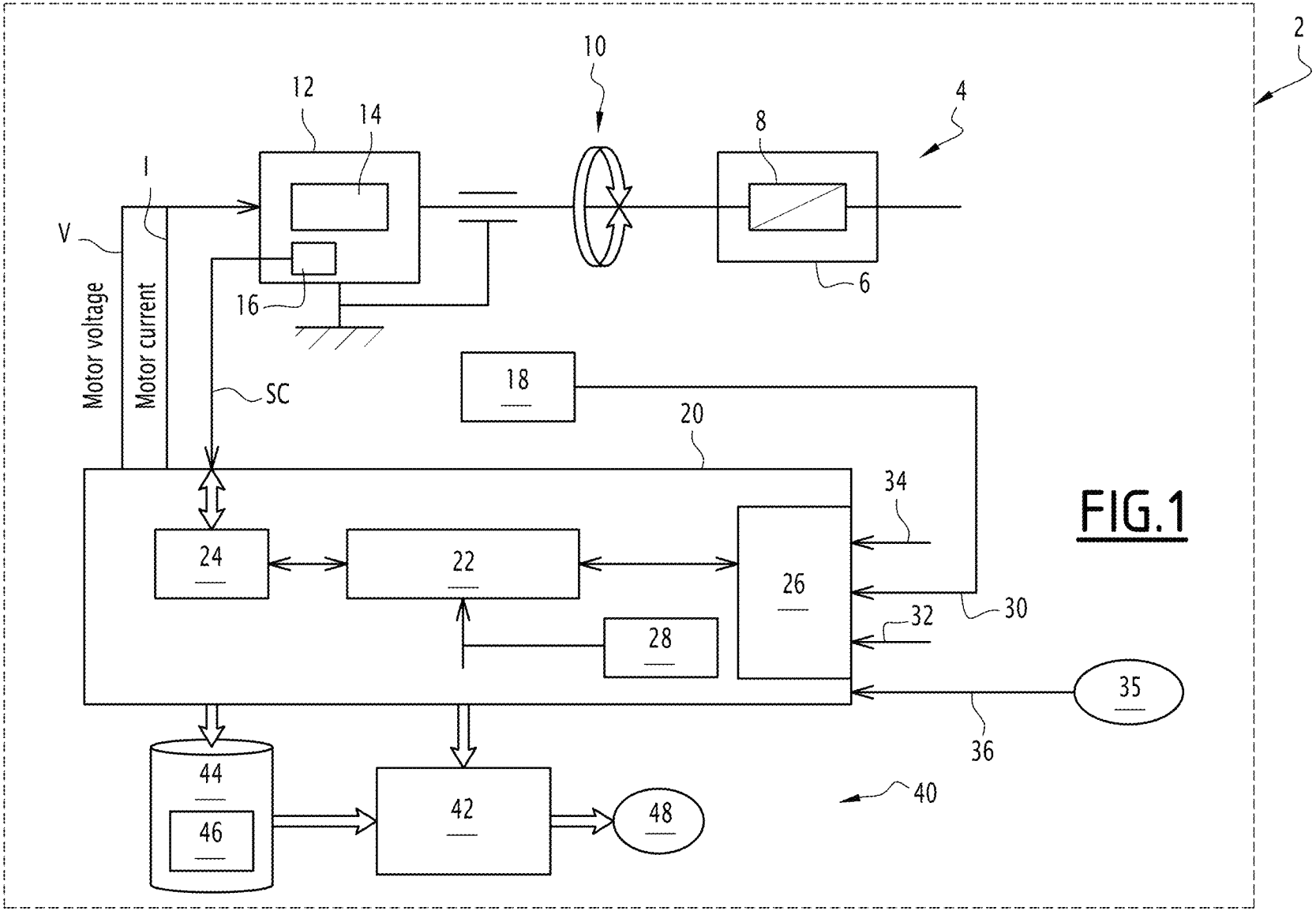
FIG. 1 schematically illustrates a detail of a railway vehicle equipped with a health status assessment device for an automatic or semi-automatic door according to one embodiment.

FIG. 1 schematically illustrates a railway vehicle portion 2, relative to an automatic door 4. In a variant, it is a semi-automatic door, for example the opening of which is actuated by a manual action (e.g., pressing a pushbutton, actuating an emergency opening module or actuating an opening module undergoing maintenance).

Hereinafter, the term "door" will encompass both fully automatic and semi-automatic doors.

It is understood that a railway vehicle generally includes several attached cars, and at least as many doors 4 as there are cars.

The railway vehicle 2 is for example a train, tram or subway, more generally called rolling stock.

In one embodiment, the doors are automatic or semi-automatic passenger access doors. However, the invention is not limited to this embodiment.

The door 4 includes a frame 6, which is a structure fixed or integrated into the body of the railway vehicle, and a leaf 8.

In one embodiment, the leaf 8 is formed by two casements able to slide in opposite directions to form a central closure. Of course, other embodiments can be considered, for example a single casement able to slide to produce the open and closed positions.

The leaf 8 is actuated by a kinematic chain 10 in particular including a motor 12 whose rotation (illustrated by an arrow in FIG. 1) drives the movement of the leaf 8 and the opening (respectively the closing) of the door 4.

The motor 12 includes a drive unit 14, supplied with electricity by an electricity source, not shown. For example, when the vehicle 2 is an electric vehicle, the drive unit is an auxiliary charge powered by the same source as the main motor (not shown) of the electric vehicle. This source is for example an electric track.

The electric current intensity I and/or the electric current voltage V supplying the drive unit 14 are controlled by a control unit 20, described below.

The motor 12 also includes or is associated with an angular position and/or speed encoder 16, which is a sensor of unknown type that makes it possible to acquire angular position or rotation speed information of the motor.

This information is sent in the form of an encoder signal SC to the control unit 20. The control unit 20 is a unit including at least one processor 22, capable of carrying out calculations by executing program code instructions. It is for example a programmable electronic board. It also includes input/output units 24, 26.

It also includes an internal clock generator 28.

The kinematic chain 10 also includes at least one switch 18, for example indicating a closed door position and/or a locked door position, and the control unit 20 receives information 30 relative to the open/closed state of each switch 18.

Furthermore, optionally, the control unit 20 receives other information 32 relative to elements, not shown, of the door 4, for example pressure on a pushbutton, activation of an emergency opening or shutoff module.

Optionally, the control unit 20 receives information 34 relative to the vehicle 2, for example centralized opening/closing orders, speed information of the train or opening authorization information.

Optionally, the control unit 20 receives context information 36, supplied by an external system 35. For example, the context information consists of any information making it possible to indicate the state of the train and its environment during the activation of the diagnostic system, for example weather data, for example the outside temperature, location data, internal data of the train, for example coming from the overall control system of the railway vehicle 2. The context information 36 is stored. Its use in one embodiment will be described hereinafter.

In all embodiments, the control unit 20 is suitable for receiving an opening command signal of the door 4, as well as a command signal to close the door 4. After such opening or closing command signals of the door, the control unit 20 is suitable for commanding the motor 12.

An actuating cycle of the kinematic chain 10 is then carried out between a first position among the open and closed positions and a second position, different from the first position, from among the closed and open positions of said door. Such an actuating cycle is characterized by a duration, and an electrical actuating energy of the kinematic chain, consumed during the duration of said cycle.

Additionally, various elements of the kinematic chain 10, for example the switches 18, change state during the duration of such a cycle.

A health status assessment system 40 of the door 4 comprises a computing unit 42 including at least one processor, suitable for executing code instructions implementing a health status assessment method as described in detail hereinafter.

In one embodiment, the health status assessment system 40 is implemented in the control unit 20.

In one alternative, it is implemented by an electronic computer separate from the control unit 20, which may be taken on board by the vehicle or remote.

The health status assessment system 40 also includes a storage unit 44, able to store data. The unit 44 in particular stores descriptor reference values 46, as explained in more detail hereinafter.

Several alternative embodiments are considered:

according to a first alternative, the computing unit 42 and the storage unit 44 are placed on board rolling stock;

according to a second alternative, the computing unit 42 and the storage unit 44 are offloaded, for example into a processing center on the ground and communicating with the control unit 20, for example by radio communication;

according to a third alternative, the computing unit 42 and the storage unit 44 are distributed, comprising an on board part, and a part on the ground. Examples of processing operations performed on board or on the ground will be given in the continuation of the description.

The health status assessment system 40 receives, as input, information relative to the kinematic chain 10, as well as information 32, 34 relative to the vehicle 2, and external commands.

This information comprises at least one characteristic measurement of the electrical energy consumed by the motor 12, for example a current or voltage measurement, and information provided by the encoder 16.

As output, the health status assessment system 40 provides a diagnosis 48, comprising, if one or more degradations are detected, a health status report and a characterization of the detected degradations.

The diagnosis is for example displayed on a screen (not shown) for potential action by a maintenance operator, or sent to a supervision system, not shown, which performs actions accordingly.

When the system comprises a display screen, said screen is preferably remote, for example located in a processing center on the ground.

Alternatively or additionally, the diagnosis 48 causes an alarm to be raised, for example visual or audio, making it possible to notify a maintenance operator of the need to take action to avoid a service outage.

Figure 2:
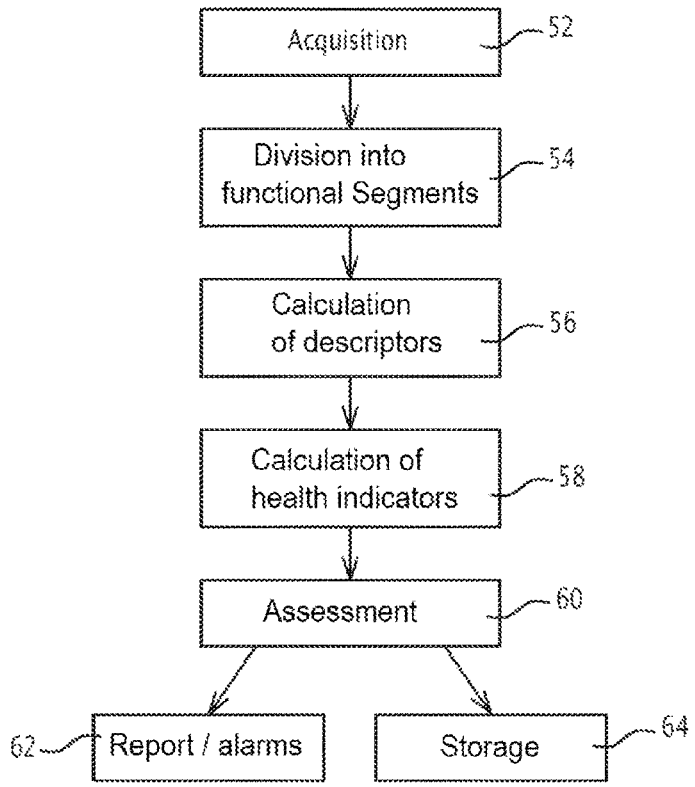
FIG. 2 is a block diagram of the main steps of a health status assessment method for an automatic or semi-automatic door according to one embodiment.

The main steps of an embodiment of the health service assessment method for a transport vehicle automatic or semi-automatic access device, implemented by the health status assessment system 40, are illustrated in FIG. 2. The method is applied to an automatic or semi-automatic door in the embodiment described in detail.

During a first acquisition step 52, health status information of the kinematic chain of the automatic or semi-automatic door in question is acquired through various means, for example by sensors or by parallel acquisitions of existing signals.

The acquisition of information relative to the health status of the kinematic chain is done on board the rolling stock (on-board mode).

In one embodiment, when the system 40 and the storage unit 44 are on board, the acquired health status information is stored and all of the processing steps described below are carried out on board.

Alternatively, the acquired health status information is temporarily stored on board in an on-board storage unit, then sent, for example at regular time intervals, for storage in a remote storage unit and processing by a remote system 40, for example in a processing center on the ground.

Steps 54 to 60 described in detail hereinafter are in this case carried out by the system 40 in a processing center on the ground, from operating information received by a communication means.

The acquisition 52 consists of acquiring several types of information.

On the one hand, information is acquired representative of the quantity of electrical energy consumed during one cycle, in particular the evolution of the current and the voltage during one cycle.

Thus, at least one signal is obtained representative of the quantity of electrical energy consumed during the cycle, for example a current signal and/or a voltage signal consumed during the cycle.

On the other hand, the angular position and/or rotation speed encoder signal SC is also obtained during this acquisition step 52. This signal provides change information in the movement, for example accelerations or decelerations, or rating changes of the motor. Furthermore, the angular position and/or rotation speed encoder signal SC can be used to calculate positions of the leaf of the door during the cycle.

Furthermore, optionally, binary information relative to open and/or closed and/or locked positions of switches 18 is also received in the acquisition step 52.

The acquisition step 52 is followed by a step 54 for dividing the cycle into a plurality of functional segments, based on information acquired in the acquisition step 52.

Indeed, an actuating cycle of the kinematic chain between a first position, for example the closed position of the door, and a second position, for example the open position, begins at a first moment $T_{init}$ for receiving a command signal for opening or opening of a given switch of the kinematic chain or by the detection of a movement of the motor or the encoder, and ends at a second moment $T_{final}$, for example given by the reception of blocking information of the door or by the detection of an end of movement of the motor.

Figure 3:
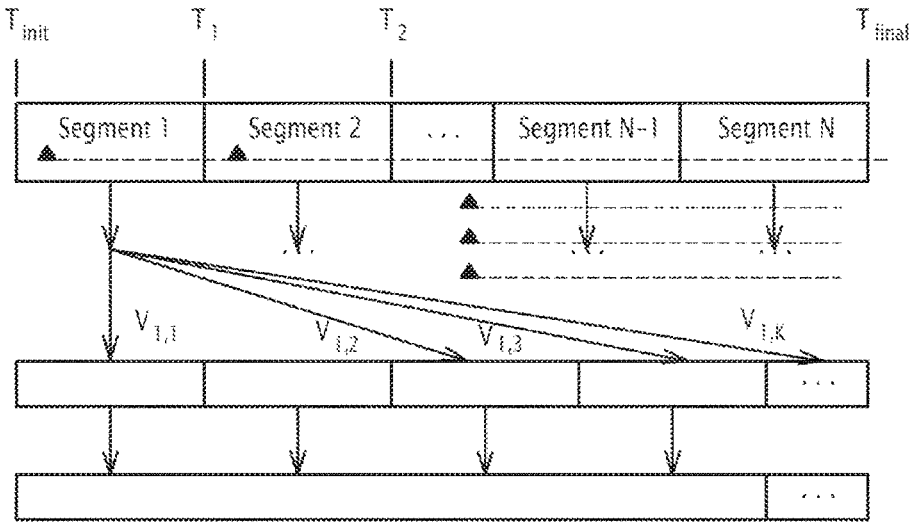
FIG. 3 schematically illustrates the division of an actuating cycle of a kinematic chain of an automatic or semi-automatic door into a plurality of functional segments.

The division 54 consists of dividing the cycle comprised between $[T_{init}, T_{final}]$ into a plurality of functional segments "Segment 1", "Segment 2", . . . , "Segment N" as schematically illustrated in FIG. 3. Each segment "Segment n" is defined by an initial moment $T_{n-1}$ and a final moment $T_n$. The functional segments have variable durations, each functional segment corresponding to an operating phase of the actuating cycle of the door. The segments for example correspond to successive phases, acceleration of the door, movement of the door at a globally constant predetermined speed and deceleration of the door.

In one embodiment, the division is done by using information taken from the position/speed encoder signal SC, for example based on rating changes of the motor or on specific positions.

According to one alternative, the division is done by using received binary information, which indicates various positions of the door, combined with the information taken from the position/speed encoder signal SC, for example based on rating changes of the motor or on specific positions.

Alternatively or additionally, the signals representative of the quantity of electrical energy consumed during the cycle are also used for this division, for example using shape recognition principles.

For example, the detection of an ascending or descending initial ramp on the motor current may be used to detect a beginning of opening or closing of the door while a stabilized current phase during a given time may be used to indicate the end of an opening or closing cycle.

For example, a current peak may determine its acceleration/deceleration, for example upon approaching a mechanical opening stop or approaching a locking phase.

It is also optionally possible to use time variables (fixed time from a point) to define a new segment.

Step 54 for dividing the cycle into functional segments is followed by a step 56 for calculating values of one or several descriptors per functional segment.

The descriptors are defined and selected beforehand.

For example, for each segment, one or several of the following descriptors are chosen:

- one or several values relative to the current and/or the voltage of the electrical energy consumed during the time interval associated with the segment, for example the average, the variance, the integral of the current and/or the voltage;
- one or several values relative to the operation of the motor, for example the average speed or the average acceleration/deceleration during the time interval associated with the segment;
- the length of time $d=T_n-T_{n-1}$ associated with the functional segment Segment n;
- the positions of the door associated with the segment start $T_{n-1}$ and segment end $T_n$ moments, obtained owing to the encoder information, may optionally be used.

In FIG. 3, as a schematic example, the descriptor values relative to the "Segment 1" functional segment, are denoted $V_{1,1} \ldots V_{1,K}$.

The calculated descriptor values are representative of the electrical energy consumed by the kinematic chain during each functional segment of the actuation cycle and/or the duration of each functional segment and/or positions of the door.

Step 56 for calculating descriptors by segment is followed by a step 58 for calculating one or several health indicators of the door, including both types of health indicators described below.

Two types of health indicators are distinguished:

- an individual health indicator is associated with a descriptor and is relative to a particular aspect of the health status. For example, an individual health indicator relative to a given descriptor and a given segment is equal to a distance between the descriptor value calculated for the segment and a reference value of said descriptor;
- an overall health indicator is calculated from values of the descriptors for all of the segments, and quantifies the overall health status of the system. Its value is strictly positive. The closer its value is to zero, the healthier the system (here, the automatic or semi-automatic door in question) is. The higher its value is, the more the system is degraded.

In one embodiment, an overall health indicator is calculated by forming an overall vector comprising at least some of the values of the descriptors, followed by calculating a distance, between the overall vector and a corresponding reference vector, in which each descriptor assumes a reference value stored beforehand, for example a value in a so-called healthy state.

For example, the calculated distance is a statistical distance, for example the Mahalanobis distance.

Alternatively, the calculated distance is a Euclidean distance.

Step 58 is followed by a step 60 for establishing a health status assessment.

This step in particular includes the degradation detection, and if a degradation is detected, the characterization of the degradation, in particular the identification of the type of degradation.

Furthermore, in one embodiment, the characterization of the degradation includes locating the degradation, for example determining the element(s) of the kinematic chain with a degraded operation, and estimating the severity of the degradation.

In one embodiment, in order to detect the degradation, the overall health indicator, calculated in step 58, is compared to predetermined good health thresholds. These good health thresholds are determined using a statistical approach from requirements in terms of false alarm rates and accurate detection rates. A degradation is detected when the value of the health status indicator exceeds a predetermined good health threshold.

A health status report is for example established periodically (step 62) and, if a significant degradation is detected, an alarm is for example emitted in step 62.

A significant degradation is for example a detected degradation whose estimated severity exceeds a predetermined severity threshold.

Advantageously, the method makes it possible to detect degradations before a failure occurs.

Furthermore, owing to the plurality of functional segments and the plurality of health status indicators used, it is also possible to identify the type of degradation and to identify the degraded part of the kinematic chain, or the non-respected adjustment or the degraded/missing consumable.

In one embodiment, in order to identify the type of degradation, a signature vector is established, comprising at least some of the individual health status indicators calculated in step 58. The part of the health status indicators to be taken into consideration for a given type of degradation is predetermined.

A similarity measurement between the signature vector and each of the reference signature vectors is calculated. Said reference signature vectors are made up of individual health status indicators calculated in step 58 for each stored degradation, for example during a test phase or when a degradation is observed, as explained hereinafter. Identifying and locating the degradation then consists of determining which of said reference signature vectors is most similar to the calculated signature vector.

For example, the performed similarity measurement is a cosine similarity measurement.

Furthermore, it is also possible to estimate the severity of the degradation, defined as the degradation level reached between the healthy state and the maximum acceptable degradation state. In one embodiment, the severity of the degradation is defined as a number commonly comprised between the nil value and the value 1. The closer the value of said severity is to zero, the more the degradation is low, or even nonexistent. The higher its value is, the more severe the degradation is.

For example, the severity is calculated as the norm of the projection of the calculated signature vector over the reference signature vector for the identified degradation.

Advantageously, the method then makes it possible to identify, locate and determine the severity of one or several degradations on the door and makes it possible to perform maintenance more precisely.

The method makes it possible, by tracking the history of the stored severity values, to determine the likelihood of failure for a given horizon.

Advantageously, the maintenance is then done on time and makes it possible to prevent the door from failing.

The inventive method has been described above for establishing health status assessments for a door during use thereof.

The method can also be used in an upstream testing phase, in particular on dedicated test benches, before installation, in particular to calculate characteristic reference values during normal operation or downgraded operation.

Furthermore, if a degradation is observed during commercial service or during a maintenance operation, after identification of the type of degradation and the downgraded elements in question and after estimating the severity of the degradation, it is possible to store the corresponding characteristic values in order to facilitate the subsequent identification of a similar degradation.

Optionally, the system also uses context information 36, which is for example stored in the storage unit 44.

The context may affect the measurement, creating disruptions. The sensitivity of the indicators to the context may optionally be tested on a dedicated test bench.

Context hereinafter refers to the vector made up of the set of values of the context information in a described situation.

In one embodiment, the values of the calculated descriptors are recalibrated relative to the context, for example using a regression method.

In another embodiment, an instance of the diagnostic system is run for each context class. A so-called context class is defined as a predefined set of context values. For example, the diagnostic of the door can be done from measurements taken at a regular interval on a defined location during the journey of the railway vehicle.

Advantageously, the influence of the context is reduced and the number of false alarms, wrongly indicating a degradation alarm, is thus decreased.

The invention claimed is:

1. A health status assessment method for a transport vehicle automatic or semi-automatic access device comprising at least one leaf suitable for being actuated by a kinematic chain including at least one motor supplied with electricity and having an associated angular position or rotation speed encoder, and at least one switch, the access device being movable between an open position and a closed position, comprising steps, carried out by a processor, for at least one actuating cycle of the kinematic chain between a first position among the open and closed positions and a second position, different from the first position, from among the closed and open positions, consisting of:

during one said cycle, acquiring information relative to the kinematic chain comprising at least one piece of information representative of the electrical energy consumed by the motor, or position or speed information provided by said encoder or binary information indicating positions of switches of the actuating kinematic chain, dividing said cycle into a plurality of functional segments based on said acquired information, calculating at least one descriptor value per functional segment, establishing a health status diagnosis comprising a degradation detection as a function of at least part of said calculated descriptor values, and, when a degradation is detected, the method further includes:

calculating one or several individual health indicators per functional segment, calculating at least one signature vector including at least some of the individual health indicators, estimating a similarity measurement between said signature vector and at least one reference signature vector representative of a degradation, and identifying the degradation based on the estimate of a similarity measurement.

2. The method according to claim 1, wherein the division into functional segments further uses acceleration/deceleration information of the motor used from information provided by said encoder.

3. The method according to claim 1, wherein each functional segment has an associated time interval, and wherein the descriptors are representative of the electrical energy consumed during said time interval or a duration of the functional segment.

4. The method according to claim 3, comprising determining acceleration/deceleration information of the motor from position or speed information provided by said encoder, and wherein said descriptor values comprise values representative of the speed or the average acceleration/deceleration of the motor during the time interval associated with each segment.

5. The method according to claim 1, comprising before establishing a diagnosis, calculating an overall health indicator based on a distance between a vector comprising all of the calculated descriptor values and a vector of reference values of corresponding descriptors previously stored.

6. The method according to claim 5, wherein said distance is a statistical distance or a Euclidean distance.

7. The method according to claim 5, wherein establishing a health status assessment comprises comparing the calculated distance to a predetermined health the operating threshold.

8. The method according to claim 1, wherein the similarity measurement is a cosine similarity measurement.

9. The method according to claim 1, further comprising estimating a detected degradation severity value, based on the signature vector and the reference signature vector associated with the identified degradation type.

10. The method according to claim 9, wherein an alarm is raised when a detected degradation severity value exceeds a predetermined severity threshold.

11. The method according to claim 1, further comprising acquiring context information before the division into functional segments, and wherein the calculation of at least one descriptor value per functional segment is done based on at least one piece of context information.

12. A health status assessment system for a transport vehicle automatic or semi-automatic access device comprising:

at least one leaf suitable for being actuated by a kinematic chain including at least one motor supplied with electricity and having an associated angular position or rotation speed encoder and at least one switch;

the access device being movable between an open position and a closed position; and a computing unit including at least one processor, the at least one processor configured to accept and execute a plurality of instructions to implement said health status assessment system and suitable for carrying out, for at least one actuating cycle of the kinematic chain between a first position among the open and closed positions and a second position, different from the first position, from among the closed and open positions, said plurality of instructions including, 1) an acquisition of information, during one said cycle, relative to the kinematic chain comprising at least one piece of information representative of the electrical energy consumed by the motor, or position, or speed information provided by said encoder or binary information indicating positions of switches of the actuating kinematic chain, 2) a division of said cycle into a plurality of functional segments based on said acquired information, 3) a calculation of at least one descriptor value per functional segment, and 4) establishment of a health status diagnosis comprising a degradation detection as a function of at least part of said calculated descriptor values, wherein the computing unit being suitable, for when a degradation is detected, to calculate one or several individual health indicators per functional segment, calculate at least one signature vector including at least some of the individual health indicators, estimate a similarity measurement between said signature vector and at least one reference signature vector representative of a degradation, and identify the degradation based on the estimate of a similarity measurement.

13. A transport vehicle including a plurality of automatic or semi-automatic access devices, each automatic or semi-automatic access device comprising at least one leaf able to be actuated by a kinematic chain including at least one motor supplied with electricity and having an associated angular position or rotation speed encoder, and being equipped with a health status assessment system for the automatic or semi-automatic access device according to claim 12.

* * * * *